US005979351A

United States Patent [19]

Fleischman et al.

[11] Patent Number: 5,979,351

[45] Date of Patent: Nov. 9, 1999

[54] TOWABLE RECREATIONAL WATER SLED

[76] Inventors: Scott D. Fleischman, 3896 Mayflower Ct., Tallahassee, Fla. 32303; Matthew A. Fleischman; Daniel G. Fleischman, both of 1905 Mahan Dr., Tallahassee, Fla. 32308

[21] Appl. No.: 09/071,998

[22] Filed: May 2, 1998

[51] Int. Cl.[6] ..... B63B 21/04

[52] U.S. Cl. ..... 114/253; 441/65; 441/69

[58] Field of Search ..... 114/315, 253, 114/254; 441/65, 75, 129, 69

[56] References Cited

U.S. PATENT DOCUMENTS

| | | | |
|---|---|---|---|
| 4,138,753 | 2/1979 | Wood | 441/129 |
| 4,619,620 | 10/1986 | Felter | 114/253 |
| 4,807,554 | 2/1989 | Chi-Hung | 114/253 |
| 5,655,939 | 8/1997 | Salvadores | 114/253 |
| 5,779,509 | 7/1998 | Barman | 114/253 |

*Primary Examiner*—Stephen Avila

[57] ABSTRACT

A towable, flexible, unsinkable water sled for accommodating single or multiple riders. The water sled is designed to be towed behind a motor boat or other similar water craft. A typical embodiment consists of a foam base (14) of flexible, unsinkable, polymer foam upon which the riders ride while being towed. It is very durable, easy to store and to prepare for use. It is easy to board, can be pulled by a motor boat (not shown) of only moderate horsepower, and can be ridden by several riders at once with very different levels of skill.

1 Claim, 3 Drawing Sheets

TOWABLE RECREATIONAL WATER SLED

BACKGROUND

1. Field of Invention

Figure 1:
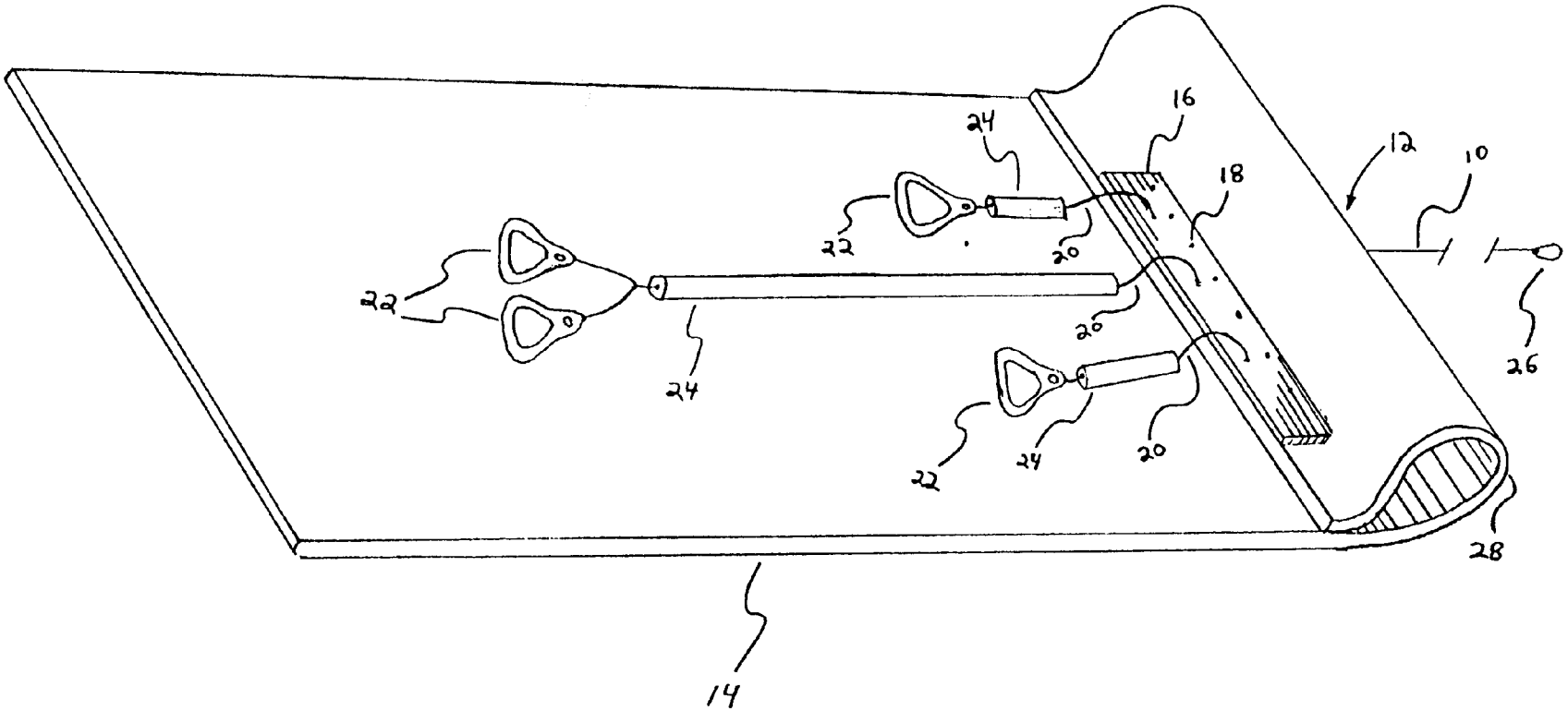

This invention is related to towable water sports vehicles, specifically to a flexible, unsinkable, non-inflatable, single or multiple passenger vehicle.

2. Discussion of Prior Art

Motor boat towable water sports vehicles generally fall into one of four categories.

A. Towable Rigid/inflatable (inflatable sailboard)
B. Towable Rigid/non-inflatable (water ski, knee board)
C. Towable Flexible/inflatable (inner tube, life raft)
D. Towable Flexible/non-inflatable (no prior art)

As indicated by the following prior art structures, none of the following water sports apparatus can be put into the flexible/non inflatable category (D). The following is a breakdown of the four categories and patents that have been issued to each, respectively.

A. Towable Rigid/inflatable

This category would pertain to devices that are generally meant to be broken down and deflated for purposes of transportation and storage. Prior art examples would be, U.S. Pat. Nos. 4,915,047, C. P. Lord, Apr. 10, 1990 5,474, 481, J. W. Ramsey, Dec. 12, 1995

B. Towable Rigid/non-inflatable

This category would pertain to commercially available devices such as the Air-Chair, knee-board and water skis. These are generally wood or plastic and may have an inner core. These are generally meant for only one rider. Prior art examples would be, U.S. Pat. Nos. 5,122,085 C. L. Heath, Jun. 16, 1992 5,057, 044 K. L. Moore, Oct. 15, 1991 5,080,620 S. S. Reden Jan. 14, 1992

C. Towable Flexible/inflatable

This category would pertain to inner tubes, torpedo style devices, chariots, etc. These products all have one or more inflatable internal cavities that are inflated with air to hold their shape and to provide buoyancy. Although these devices are flexible, there flexibility is rather limited due to the nature of the inflated chamber. Also these devices are generally not meant to flex while being used. Prior art examples would be, U.S. Pat. Nos. 4,619,620 M. R. Felter, Oct. 28, 1989 5,006,087 L. L. Petersen, Apr. 9, 1991 5,279,510 A. P, Ramsey, Jan. 18, 1994 5,360,360 L. L. Petersen, Nov. 1, 1994 5,383,804 J. E. Mitch, K. E. Mitch, Jan. 24, 1995 5,503,099 L. L. Petersen, Apr. 2, 1996.

D. Towable Flexible/non-inflatable

This category has no known prior art.

All prior art devices exhibit only a minor degree of flexibility.

All prior art devices intended to exhibit some flexibility, require inflation and exhibit its disadvantages such as punctures, etc.

All prior art devices can be difficult to board in deep water.

Objects and Advantages

Accordingly, besides the objects and advantages of the flexible water sled described in my above patent, several objects and advantages of the present invention are:

(a) To provide water sled with a totally flexible base which allows the apparatus to flex laterally and longitudinally.

(b) To provide a durable, unsinkable water sled.

(c) To provide a water sled which requires no inflation to be ready for use, maintain its shape or provide buoyancy.

(d) To provide a water sled that is easily boarded in deep water due to the fact that the water line is practically level with the water.

(e) To provide an water sled which can easily accommodate from one to four or more riders.

(f) To provide a water sled which can provide a physically challenging ride while being towed behind a boat of only moderate horsepower.

Still other objects and advantages will become apparent from a consideration of the ensuing description and drawings.

DRAWING FIGURES

FIG. 1 Top view showing the preferred arrangement of the handles, ropes, head board and foam base of the water sled.

Figure 2:
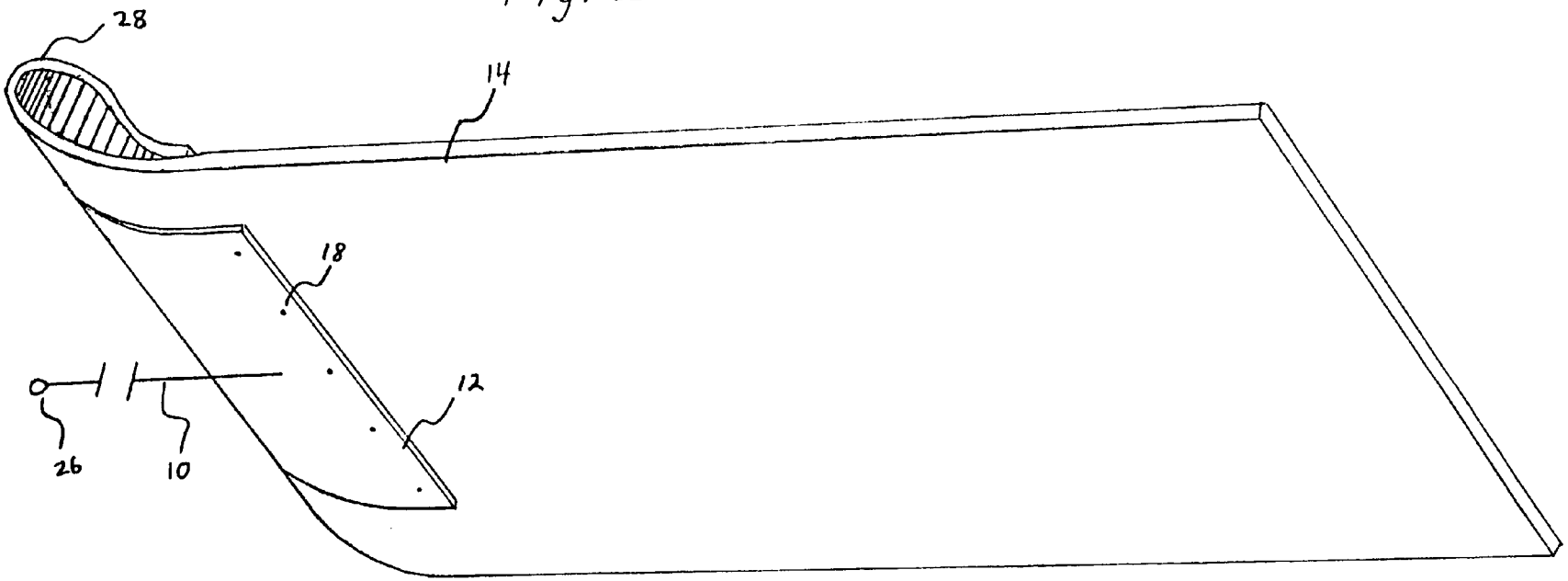

FIG. 2 Bottom view showing planing ski and tow-line.

Figure 3:
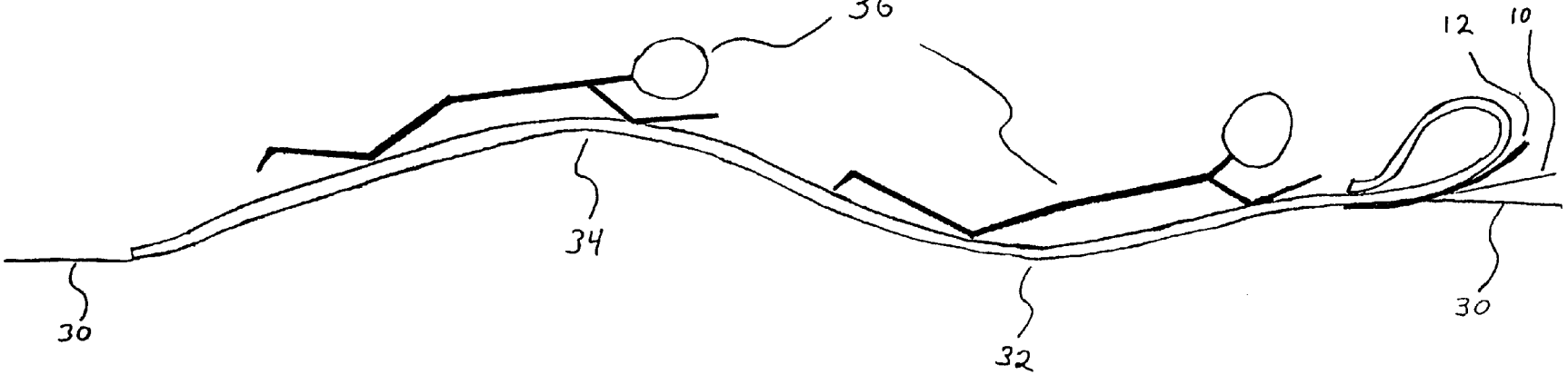

FIG. 3 Side view of water sled with riders.

Reference Numerals In Drawings

10. TOW-LINE
12. PLANING SKI
14. FOAM BASE
16. HEAD BOARD
18. HARDWARE
20. ROPE
22. HANDLES
24. FOAM ROPE COVER
26. TOW-LINE FASTENER
28. FOLDED NOSE DESIGN
30. WATER SURFACE
32. STABLE LOW SPOT
34. UNSTABLE HIGH SPOT
36. RIDERS

DESCRIPTION - FIGS. 1–2

A typical embodiment of the closure of the present invention is illustrated in FIG. 1 (top view) and FIG. 2 (bottom view). This is a category D, towable, flexible, non-inflatable device. The water sled apparatus has a foam base (14) made closed cell, unsinkable, polymer foam. If increased bouyancy were desired, inflatable sections (not shown) could be added to the foam base. The base has the approximate dimensions of five feet wide, 12 feet long. The flexibility of this foam allows the apparatus to flex (laterally and longitudinally) and conform to the waves acting upon it. Atop of the water sled are a number of handles (22) that allow the riders to hang on while being towed. The handles (22) are secured to the head board (16). The ropes (20) are covered with a soft polymer foam to prevent the ropes (20) from becoming entangled and to prevent the riders from chaffing from rubbing against the ropes (20).

The head board (16) may be covered with a protective material to protect the ropes (20) from damage by rubbing. Another function of the head board (16) is to hold the front of the water sled in the folded nose design (28). This head board (16) is secured to the planing ski (12) underneath by hardware (18) as seen in FIG. 1 (top) and FIG. 2 (bottom).

The planing ski (12) could conceivably be mounted inside, or on top of the fold of the folded nose design (28).

The preferred design for the front of the water sled is the folded nose configuration (28). This design is used to prevent water from spraying over the front of the apparatus and to also provide a shape which will prevent the apparatus from diving or digging into the water when encountering large waves. It also provides an added degree of buoyancy in the front, due to the double layer of foam. This aids in assuring that the water sled planes properly when being towed.

FIG. 2 (bottom view) shows the planing ski (12) and hardware (18) in relation to the bottom of the water sled. The planing ski (12) is designed to aid in the planing of the water sled by forcing the front of the water sled upward as it is towed through the water. The planing ski (12) is preferably made of hard plastic and has a upward curving edge which allows the water sled to stay planed. If a stiffer material were used for the foam base (14), the planing ski (12) could be eliminated while still maintaining a shape that is favorable to planing. A stiffer material could also prevent folding of the foam base (14) at the point of attachment of the towline (10).

The tow-line (10) attaches to the planing ski (12) and has a fastener (26) on the opposite end for releasable capture of the water sled to the towing vehicle (not shown) (FIG. 1, 2).

OPERATION-FIG. 3

To prepare the water sled for operation, the sled must be placed in the water, and the tow line must connected to a motor boat or other suitable means for towing. The riders climb onto the sled, and the boat will then tow the riders and sled.

This water sled exhibits several advantages over other towable water vehicles.

The water sled is very easy to board. As the riders climb onto the water sled, the foam base sinks slightly allowing the riders to board without having to climb out of the water.

The riders are generally placed two in front and two in back, although any combination or reasonable number of riders could be used.

Due to the flexible properties of the base, the ride experienced by the riders in front, as opposed to the riders in back, is very different This difference in ride intensity experienced by the front and rear riders is a dramatic improvement over all prior art. The riders in the front positions experience a reasonably gentle ride which is excellent for younger or weaker riders. As the water sled is towed, weight of the front riders creates low spot in the water under them, and a reactionary high spot directly behind them (FIG. 3). The rear riders are positioned directly on top of this high spot, which is very unstable, and creates an extremely challenging ride. This difference in ride intensity is excellent for family activities where members with great differences in physical strength are likely to be present.

The water sled possesses a very large surface area which causes the sled to plane at low speeds, even with a large number of riders. This allows effective operation of the sled, even with motor boats having only moderate horsepower. Motor boats that could never tow four skiers may easily pull four riders on this water sled.

The water sled is very durable, its operation is not effected by minor cuts, tears or punctures because it is constructed of unsinkable, flexible, polymer foam.

The sled can easily be rolled up for compact storage, and requires no preparation, assembly or inflation before operation.

The design of the water sled is very simple, allowing very low construction costs.

SUMMARY, RAMIFICATIONS AND SCOPE

Accordingly, the reader will see that the water sled of this invention allows for singular or multiple riders to be towed behind a motor boat or other similar water craft. Furthermore the water sled has the additional advantages in that

- it can simultaneously provide an extremely challenging ride for some, and a more gentle ride for others;
- it is very durable, easy to store and to prepare for use;
- it is easy to board in deep water;
- it can be pulled by a boat of only moderate horsepower;
- can be ridden by several riders at once with very different levels of skill.

While my above description contains many specificities, these should not be construed as limitations on the scope of the invention, but rather as an exemplification of one preferred embodiment thereof. Many other variations are possible. For example, the planing ski could be mounted inside the front fold or even on top of the water sled. The dimensions of the water sled could be reduced for as little as one rider, or increased to accommodate as many riders as desired. The shape of the foam base could be other than rectangular, such as circular, triangular, etc. Accordingly, the scope of the invention should be determined not by the embodiment illustrated, but by the appended claims and their legal equivalents.

We claim:

1. A towable recreational water sled for accommodating a singular or plurality of rider(s), comprising:

a. a planar sheet of flexible, unsinkable, non-inflatable polymer material, b. means for attaching a towline to the sheet of material to allow towing by a suitable water craft, c. means for riders to grip said water sled while being towed, d. means for providing the front section of the sheet of material with a geometry the will plane easily and e. means for stiffening the front section of the sheet of material to prevent folding at the point of attachment of the towline without reducing flexability of the remainder of the sheet.

* * * * *